US012116090B2

(12) United States Patent
Olofsson et al.

(10) Patent No.: US 12,116,090 B2
(45) **Date of Patent: *Oct. 15, 2024**

(54) FENDER ARRANGEMENT FOR DOCKING A MARINE VESSEL WITH A BOAT LANDING OF A MARINE OFF-SHORE STRUCTURE

(71) Applicant: Northern Offshore Services AB, Vastra Frolunda (SE)

(72) Inventors: Markus Olofsson, Donso (SE); Johannes Ahlstrom, Vastra Frolunda (SE); Ronny Gustafsson, Gothenburg (SE)

(73) Assignee: NORTHERN OFFSHORE SERVICES AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/832,567

(22) Filed: Jun. 3, 2022

(65) Prior Publication Data

US 2022/0297807 A1 Sep. 22, 2022

Related U.S. Application Data

(63) Continuation of application No. 17/039,452, filed on Sep. 30, 2020, now Pat. No. 11,377,179, which is a (Continued)

(30) Foreign Application Priority Data

Jan. 8, 2016 (EP) ..... 16150601

(51) Int. Cl.

| | |
|---|---|
| ***B63B 59/02*** | (2006.01) |
| ***B63B 21/00*** | (2006.01) |
| ***B63B 21/02*** | (2006.01) |

(52) U.S. Cl.
CPC ..... *B63B 59/02* (2013.01); *B63B 21/00* (2013.01); *B63B 21/02* (2013.01); *B63B 2059/025* (2013.01)

(58) Field of Classification Search
CPC ... B63B 21/00; B63B 21/02; B63B 2021/003; B63B 2021/006; B63B 59/00; B63B 59/02; B63B 2059/025; E02B 3/26
(Continued)

(56) References Cited

U.S. PATENT DOCUMENTS 3,820,495 A 6/1974 Ueda
3,864,922 A * 2/1975 Dial ..... E02B 3/26 213/7

(Continued)

FOREIGN PATENT DOCUMENTS

EP 2298641 A2 3/2011
EP 2500256 A1 9/2012

(Continued)

OTHER PUBLICATIONS

International Search Report and Written Opinion, as issued in connection with International Patent Application No. PCT/SE2017/050008, mailed Apr. 13, 2017, (12 pages).

(Continued)

*Primary Examiner* — Daniel V Venne

(57) ABSTRACT

Fender arrangement for docking a marine vessel (1) with a boat landing (2) of a marine offshore structure (3) such as a wind power plant, including at least one fender unit (12, 13) composed of elastically deformable material and provided with a receiving recess (18) for a docking rail (5) of said boat landing (2). The fender arrangement is especially characterized in that fender unit (12, 13) exhibits an internal deformation control cavity (20) positioned at a distance from the receiving recess (18) within the fender unit (12, 13) and (Continued)

extending at least along the width of said receiving recess (18), controlling deformation of the fender unit (12, 13) into forming a gripping hold of a docking rail (5) by compression of the internal deformation control cavity (20) when the fender unit (12, 13) is pressed against the docking rail (5).

10 Claims, 5 Drawing Sheets

Related U.S. Application Data continuation of application No. 16/960,545, filed as application No. PCT/SE2017/050008 on Jan. 5, 2017, now Pat. No. 11,091,236.

(58) Field of Classification Search
USPC ..... 114/219, 230.1
See application file for complete search history.

(56) References Cited

U.S. PATENT DOCUMENTS

| | | | | |
|---|---|---|---|---|
| 3,974,794 | A | 8/1976 | Kakitani et al. | |
| 4,309,956 | A * | 1/1982 | Yamaguchi | B63B 59/02 114/249 |
| 4,532,879 | A * | 8/1985 | Ortloff | B63B 22/025 114/230.14 |
| 6,435,122 | B1 * | 8/2002 | Skulnick | B63B 59/02 114/219 |
| 6,910,435 | B2 * | 6/2005 | Hadcroft | B63B 21/00 114/230.18 |
| 7,527,454 | B1 * | 5/2009 | Brushaber | E02B 3/26 267/140 |
| 8,408,153 | B2 | 4/2013 | Montgomery | |
| 11,091,236 | B2 | 8/2021 | Olofsson et al. | |
| 2013/0312204 | A1 | 11/2013 | Bedford | |
| 2015/0251737 | A1 | 9/2015 | Moran | |

FOREIGN PATENT DOCUMENTS

| | | | |
|---|---|---|---|
| EP | 2500256 | B1 | 7/2014 |
| EP | 2818396 | A1 | 12/2014 |
| EP | 2818400 | A1 | 12/2014 |
| EP | 2829468 | A2 | 1/2015 |
| GB | 2487045 | A | 7/2012 |
| WO | 2005100145 | A1 | 10/2005 |
| WO | 2015160119 | A1 | 10/2015 |

OTHER PUBLICATIONS

US Office Action in U.S. Appl. No. 16/960,545, dated Jan. 8, 2021, 7 pgs.
US Office Action in U.S. Appl. No. 17/039,452, dated Jul. 6, 2021, 7 pgs.
US Office Action in U.S. Appl. No. 17/039,452, dated Oct. 18, 2021, 6 pgs.
US Office Action in U.S. Appl. No. 17/039,452, dated Mar. 19, 2021, 6 pgs.
US Office Action in U.S. Appl. No. 17/039,452, dated Nov. 5, 2020, 6 pgs.
Notice of Allowance in U.S. Appl. No. 17/039,452, dated Mar. 15, 2022, 7 pgs.
Extended European search report issued in connection with EP Patent Application No. 16150601.9, mailed Jun. 23, 2016, 6 pages.
International Preliminary Report on Patentability as issued in connection with International Patent Application No. PCT/SE2017/050008, mailed Apr. 13, 2018, 9 pages.
Notice of Allowance in U.S. Appl. No. 16/960,545 dated May 18, 2021, 8 pages.
Non-Final Office Action in U.S. Appl. No. 18/064,242 dated Apr. 18, 2023, 8 pages.

* cited by examiner

FENDER ARRANGEMENT FOR DOCKING A MARINE VESSEL WITH A BOAT LANDING OF A MARINE OFF-SHORE STRUCTURE

CROSS-REFERENCE TO RELATED APPLICATIONS

This application is a continuation application claiming priority under 35 U.S.C. § 120 to U.S. patent application Ser. No. 17/039,452, filed Sep. 30, 2020, entitled "Fender arrangement for docking a marine vessel with a boat landing of a marine off-shore structure," claiming priority under 35 U.S.C. § 120 to U.S. patent application Ser. No. 16/960,545, filed Jan. 5, 2017, entitled "Fender arrangement for docking a marine vessel with a boat landing of a marine off-shore structure."

TECHNICAL FIELD

The invention relates to a fender arrangement for docking a marine vessel with a boat landing of a marine offshore structure such as a wind power plant, including at least one fender unit arranged to abut at least one docking rail of said boat landing structure. The fender unit is at least partially composed of elastically deformable material and is provided with a receiving recess for said docking rail.

BACKGROUND

Marine offshore structures are built to withstand a harsh environment in heavy seas and stormy weather for a long service life at sea. The demanding weather conditions also make it a real challenge to service and maintain the structures in a safe and efficient way. The increasing use of wind power plants in offshore wind power farms at sea or in coastal waters has created a niche market for small service vessels which are used to safely and expediently deliver and pick up service personnel and equipment to and from offshore wind power plants. The wind power plants are often grouped together in large arrays or "farms" and the service vessels are kept busy in the regular maintenance work required on these sites.

In this type of service work it is essential to make the transfer of personnel as safe as possible in a very dangerous work environment among rough seas and strong winds. In order to facilitate the transfer, the wind power plants are normally provided with a standardized type of boat landing with two sturdy parallel docking rails extending vertically along the pillar shaft of the wind power plant. The service vessel is equipped with sturdy fenders designed to abut the docking rails. A ladder and several landing platforms are positioned between the docking rails so that the service personnel are protected from potential risk of being crushed between the service vessel and the docking rails. In heavy seas there are substantial forces involved as the service vessel approaches the boat landing and due to sudden heaving motions causing the fenders of the service vessel to slide along the docking rails.

Existing fender arrangements for service vessels of the type described above range from simple traditional rubber fender blocks to complex fender systems provided with mechanical gripping arms for holding on to the docking rails. A problem with the traditional fender blocks is that they require the service vessel to constantly press against the wind power plant with considerable power in order to stay docked with the docking rails during the personnel transfer. This results in large quantities of fuel having to be used just for maintaining the vessel in docking position. Considering the large amount of individual wind power plants to be serviced in a typical wind power plant site, the extra fuel costs involved for the docking procedures are considerable. This type of "push-and-hold" docking procedure without any gripping action on the docking rails also results in rapid friction wear of the fender blocks due to vertical sliding movement against the docking rails.

The more advanced fender arrangements known on the market involves various designs to allow the service vessel to hold on to the docking rails by gripping them. This considerably reduces the fuel cost involved in the previously described "push-and-hold" docking procedure since there is no longer a need to continuously push against the wind power plant in order to hold the vessel in a docking position. An example of one such known solution is described in EP 2 500 256 B1, wherein the docking rails are physically held with two mechanical gripping arms provided on a common mounting rail attached to the service vessel. The gripping arms are additionally provided with multiple rollers to allow reduced friction in a relative vertical movement along the docking rail. A problem with such a device is the potential vulnerability of the numerous mechanical components in a very harsh work environment. Complex arrangements like this also tend to be costly.

SUMMARY AND OBJECT OF THE INVENTION

It is the object of the present invention to alleviate the above mentioned problems by providing a fender arrangement which requires considerably less power in the docking procedure than known "push-to hold" docking solutions and is less complex and costly than fender units with mechanical gripping arms. The invention still offers a mechanically simple and robust fender design that will withstand the harsh operating conditions in an offshore environment with minimal maintenance costs. Hence, the invention provides a fender arrangement for docking a marine vessel with a boat landing of a marine offshore structure such as a wind power plant, including at least one fender unit composed of elastically deformable material and provided with a receiving recess for a docking rail of said boat landing, The fender arrangement is especially characterized in that that the fender unit exhibits an internal deformation control cavity positioned at a distance from the receiving recess within the fender unit and extending at least along the width of said receiving recess, controlling deformation of the fender unit into forming a gripping hold of a docking rail by compression of the internal deformation control cavity when the fender unit is pressed against the docking rail.

In an preferred embodiment of the invention, the receiving recess is wider than the docking rail in an uncompressed state of the fender unit and that the fender unit exhibits a first projecting side end-portion and a second projecting side end-portion forming the sides of the receiving recess. The projecting side end-portions are elastically pressing against opposite sides of the docking rail in a compressed state of the fender unit as a central portion of the receiving recess is pressed against the docking rail and the internal deformation control cavity is compressed. To achieve this, the projecting side end-portions are operationally joined with the central portion of the receiving recess.

In one embodiment, the first projecting end-portion protrudes further than said second projecting end-portion.

In a predominant embodiment of the invention, the fender unit embraces a docking rail with a circular cross-section. In this embodiment, the embracing angle exceeds 180 degrees.

In a favorable embodiment of the invention, the projecting side end-portions each exhibit an upper and a lower slanted guide face opening up the grip of the fender unit around a docking rail upon vertical sliding contact with a lateral docking rail support strut of the boat landing, The slanted guide faces engage the lateral docking rail support strut, forcing the projecting side end portions apart to disengage the docking rail.

In an advantageous embodiment of the invention, the fender unit is partially hollow and exhibits multi-stage elastic compression characteristics provided by: a primary internal deformation control cavity or group of cavities located adjacent to the receiving recess, providing a first, weak compression stage as the fender unit is pressed against a docking rail, and—a secondary internal deformation control cavity or group of cavities located farther from the receiving recess relative to said first deformation control cavity or group of cavities, providing a second, stiffer compression stage relative to said first weak compression stage.

In an alternative embodiment of the invention, at least one secondary internal deformation cavity is provided with a pneumatically or hydraulically activated hollow stiffening body for enabling external active variable deformation stiffness control via a control apparatus.

In yet an alternative embodiment of the invention, the projecting side end-portions are provided with pneumatically or hydraulically activated hollow expansion bodies for enabling externally activated expansion of the end-portions, causing an active gripping action against the docking rail by inflating the hollow expansion bodies, said activation being selectively controlled via a control apparatus.

According to another embodiment of the invention, at least one projecting side end-portion of the fender unit is provided with an electromagnet which is externally activated by a control unit to magnetically grip a docking rail made of a ferrous material.

Finally, in a beneficial embodiment of the invention, the receiving recess of the fender unit is provided with multiple suction cup elements adapted to adhere by suction to the docking rail as the fender unit is pressed against the docking rail.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

DETAILED DESCRIPTION OF EXAMPLE EMBODIMENTS OF THE INVENTION

The invention will now be described with reference to embodiments of the invention and with reference to the appended drawings. With initial reference to FIG. 1, this figure shows a schematic overview of a fender arrangement according to the present invention fitted on a marine vessel 1 in the process of docking with a boat landing 2 of a marine offshore structure 3 such as a wind power plant. In the simplified figure, only a limited section of the marine offshore structure 3 is shown as a partial cross section of a cylindrical support pillar 4 to said wind power plant. It should be noted that the invention is applicable to any kind of marine offshore structure 3 and that its use is not limited to wind power plants only.

Figure 1:
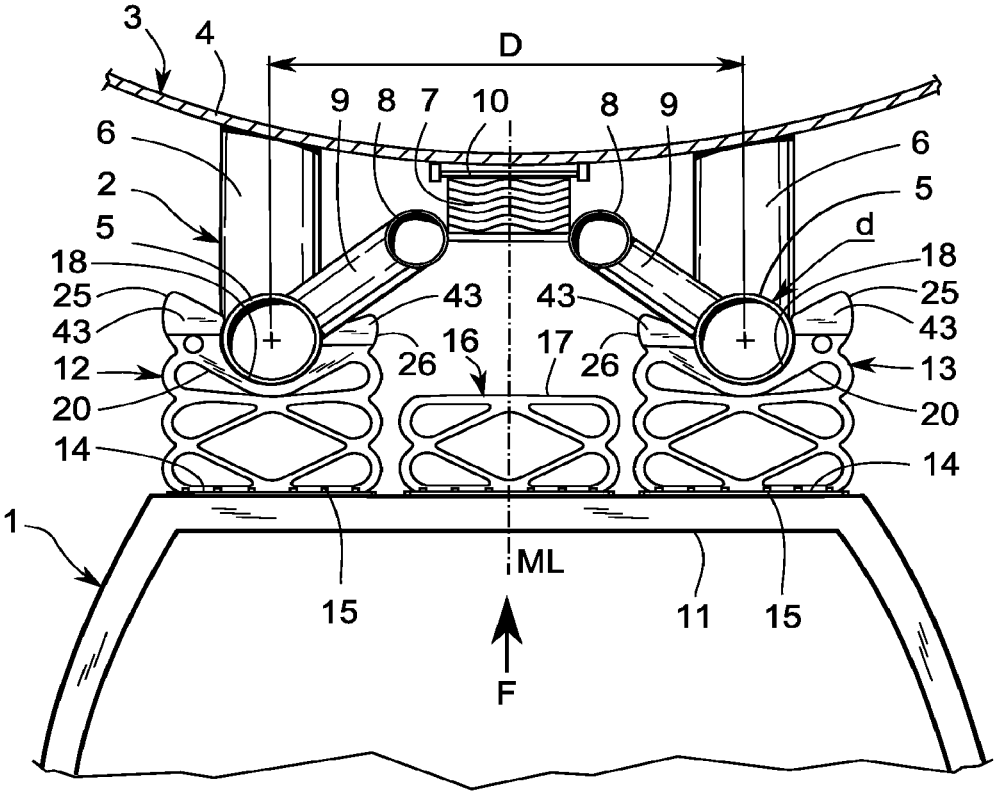
FIG. 1 shows a simplified schematic overview of a fender arrangement according to the present invention fitted on a marine vessel in the process of docking with a boat landing of a wind power plant.

The boat landing 2 is shown in FIG. 1 as a simplified generic type of a boat landing in widespread current use. Hence the boat landing 2 is provided with two parallel, cylindrical docking rails 5 of circular cross section and extending vertically along the support pillar 4. The docking rails 5 protect the support pillar 4 from structural damage during docking procedures and are held at a predefined distance from the support pillar 4 by means of sturdy horizontal supports 6. A landing platform 7 is provided between the two docking rails 5 in order to offer a safe landing for service personnel when boarding or disembarking the marine offshore structure 3. The landing platform 7 is supported by two support rails 8 extending in parallel with the docking rails 5. The support rails 8 are themselves supported by lateral docking rail support struts 9 extending from the docking rails 5. From the landing platform 7, service personnel (not shown) use a ladder 10 which extends vertically along the support pillar 4 for further access to the marine offshore structure 3. The distance D between the two docking rails 5 is widely standardized as is the diameter d of the docking rails 5, even if smaller variations exist on various boat landings 2. Again, the actual configuration of the boat landing 2 may vary, but the positions, diameter and mutual distance D of the docking rails 5 are largely standardized.

The marine vessel 1 is only partially shown in a very simplified way as seen from above in FIG. 1. It has a generally flat bow portion 11 above the waterline where the fender arrangement according to the invention is mounted symmetrically relative to a mid-ship line ML shown with dash-dotted lines. The marine vessel 1 may be of a mono-hull, catamaran-hull or trimaran-hull type. A port fender unit 12 and a starboard fender unit 13 uniquely shaped according to the invention is attached to the bow portion 11 with mounting consoles 14 secured by multiple bolts 15 for easy disassembly or replacement if required. The exemplifying embodiment shown in FIG. 1 further includes a central fender unit 16 mounted between the port fender unit 12 and the starboard fender unit 13. The central fender unit 16 is used as a stepping platform by the service personnel as they stepover to the landing platform 10. It may conveniently have a flat front surface 17 unlike the more complex shapes of the port fender unit 12 and the starboard fender unit 13 as shown in the FIG. 1 and which will be described in greater detail in the following description.

The port fender unit 12 and the starboard fender unit 13 are arranged to abut the docking rails 5 as the marine vessel 1 is pressed against the docking rails 5 with a docking force as indicated by the force arrow F. The fender units 12, 13 of the shown embodiment are composed entirely of elastically deformable material and are each provided with a receiving recess 18 for said docking rail 5. Preferably, a resilient, easily moldable polymer material such as for example polyurethane is used in the fender units 12, 13, but natural rubber may also be used as an alternative. Reinforcements with non-elastic reinforcement elements (not shown) may be integrated into the fender units 12, 13 during the molding process if required. However, any such reinforcement elements are positioned so that they do not limit the elastic deformation characteristics of the fender units 12, 13.

Figure 2:
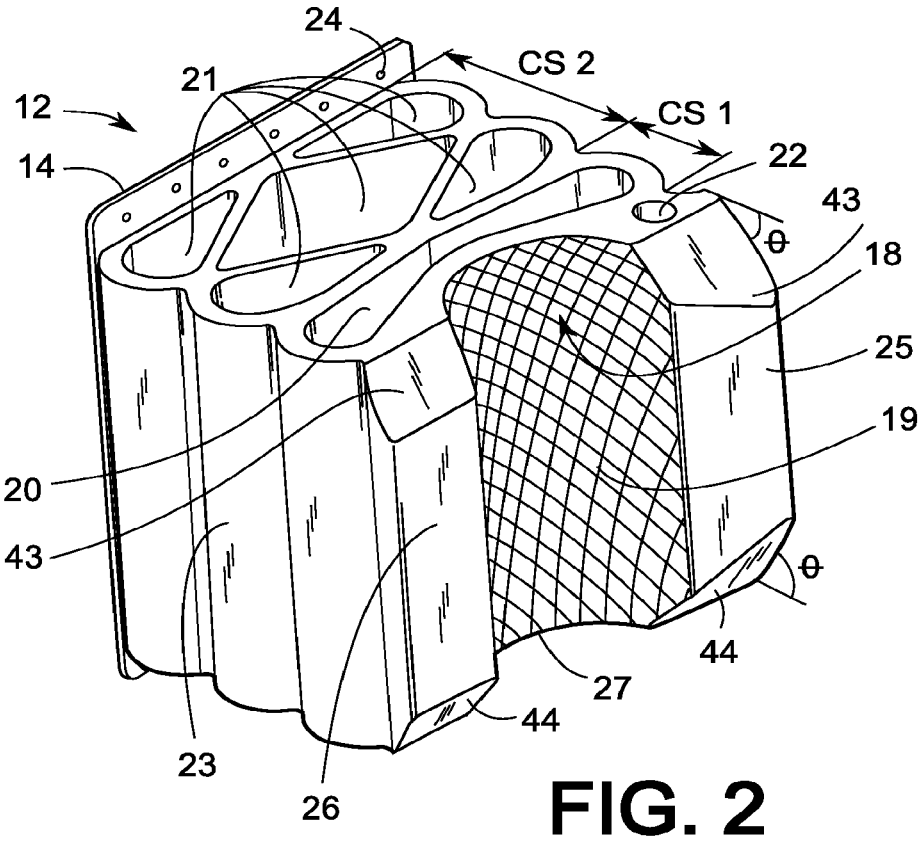
FIG. 2 shows a perspective view of a fender unit according to a first exemplifying embodiment of the invention.

In FIG. 2, a perspective view of the port fender unit 12 is shown separately in order to closer describe the features of the present invention. Although the starboard fender unit 13 is not shown separately in this figure, it is in fact identical to the port fender unit 12, only mounted with a 180 degrees reversed orientation so that it appears like a mirror image of the port fender unit 12 in FIG. 1. Hence, only the port fender unit 12 will be described in the following figures since both fender units 12, 13 are designed to work in identical ways with respect to their respective docking rails 5. As shown in FIG. 2, the receiving recess 18 is provided with a friction-enhancing pattern 19 (e.g., diagonal square or diamond shape pattern) molded in relief in the fender material in order to increase the gripping friction between the fender unit 12, 13 and the docking rail 5 (not shown in the figure) in order to prevent vertical slip between them in a docking procedure. The friction-enhancing pattern 19 may of course be shaped in other shapes than the one shown in this first exemplary embodiment, such as pebble shapes, stripes or other shapes as long as the standout in relief from the surface of the receiving platform 18.

As shown both in FIG. 1 and FIG. 2, the fender unit 12, 13 exhibits an internal deformation control cavity 20 positioned at a distance from the receiving recess 18 within the fender unit 12, 13. This internal deformation control cavity 20 extends at least along the width of the receiving recess 18, controlling deformation of the fender unit 12, 13 into forming a gripping hold of a docking rail 5 by compression of the internal deformation control cavity 20 when the fender unit 12, 13 is pressed against the docking rail 5—as described in detail further down in this description with reference to FIG. 4. In the shown embodiment, the internal deformation control cavity 20 extends wider than along the width of the receiving recess 18, more particularly almost twice the width of the receiving recess 18. By the term "width of the receiving recess 18" is here meant the lateral width in a horizontal plane, i.e. the plane of the drawing sheet of FIG. 1.

The fender unit 12, 13 exhibits multi-stage elastic compression characteristics provided by:

- a primary internal deformation control cavity 20 located adjacent to the receiving recess 18, which in addition to controlling the grip of the fender unit 12, 13 as described above, also provides a first, weak compression stage CS 1 as the fender unit 12, 13 is pressed against a docking rail 5 as will be further described in the following figures, and
- a group of five secondary internal deformation control cavities 21 located farther from the receiving recess 18 relative to said primary deformation control cavity 20, providing a second, stiffer compression stage CS 2 relative to said first weak compression stage CS 1.

In FIG. 2 as well as the following FIGS. 3-6, the correlation between the compression stages CS 1 and CS2 and the internal deformation control cavities 20, 21 are illustrated with the arrows marked CS 1 and CS 2, respectively in the figure—although this illustration does not indicate a specific compression state as such. The actual compression states as a result of a progressively increasing compression force F will instead be shown consecutively as compression gradually progresses in FIGS. 4-6.

In alternative embodiments to be described further on in this description, the fender unit 12, 13 may have a group of primary internal deformation control cavities 20. Likewise, alternative embodiments may have only one single second internal deformation control cavity 21 instead of a group of them like in FIG. 2. The internal deformation control cavities 20 and 21 extend through the port fender unit

12 in parallel with the extension of the fender unit 12 which in the shown embodiment has open ends facilitating the molding manufacturing process of the port fender unit 12 and saves weight. The same applies of course to the starboard fender unit 13, although only the port fender unit 12 is shown in the figures. Hence any referral to the port fender unit 12 or simply "fender unit 12" in the following description equally applies to the starboard fender unit 13.

In order to save even more weight, the fender unit 12 in the shown first embodiment further has a through-going weight-saving cavity 22 which extends in parallel with the internal deformation control cavities 20 and 21. This embodiment also exhibits accordion-shaped or "bellows-shaped" curved sides 23, the purpose of which are to control the compression characteristics of the fender unit 12 together with the correspondingly shaped internal deformation control cavities 20 and 21 inside the fender unit 12. The mounting console 14 is made of metal and is conveniently used as a base surface in the molding process of the remaining fender unit 12. Prior to molding, the mounting console 14 is sand blasted to obtain a rough surface and a coat of primer is applied. Then the polyurethane material is molded directly onto the mounting console 14 and bonds to its surface. The mounting console 14 is also provided with multiple mounting holes 24 for mounting the fender unit 12 to a marine vessel 1 as shown in FIG. 1.

Figure 3:
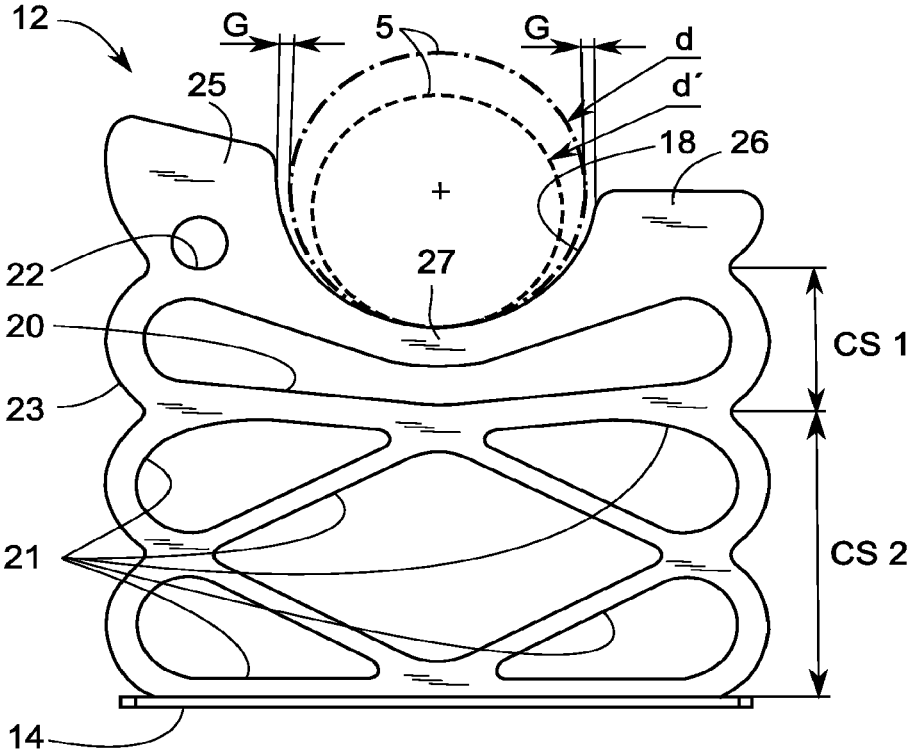
FIG. 3 shows a view from above of a fender unit according to the first embodiment in an uncompressed condition. Two different dimensions of docking rails—both with a circular cross-section—are shown with dotted lines and positioned in the receiving recess just prior to the docking procedure.

With reference now to FIG. 3, this figure shows a view from above of a fender unit 12 according to the first embodiment in an uncompressed condition. Two different dimensions of docking rails 5—both with a circular cross-section—are shown in the figure, namely a larger one indicated with dash-dotted lines having a larger diameter d and a smaller one indicated with dotted lines having a smaller diameter d'. The port fender unit 12 and the starboard fender unit 13 are designed to accommodate for both standardized docking rail diameters d and d', respectively. This will be demonstrated below with reference to FIGS. 4 and 5. In FIG. 3, however, the docking rail 5 is positioned in the receiving recess 18 just prior to a docking procedure. Notably, the receiving recess 18 is wider than the docking rail 5 in an uncompressed state of the fender unit 12 shown in FIG. 3 and that the fender unit 12 exhibits a first projecting side end-portion 25 and a second projecting side end-portion 26 forming the sides of the receiving recess 18. As seen in FIG. 3, the first projecting end-portion 25 protrudes further than said second projecting end-portion 26, measured from the mounting console 14 and it forms the outboard projecting end-portion as measured from the midship line ML in FIG. 1 when the port fender unit 12 is mounted on the marine vessel 1. This applies also to the starboard fender unit 13 which is mounted as a mirror image of the port fender unit 12 and hence will not be separately described here as mentioned initially. In the uncompressed stage shown in FIG. 3, a small gap G is formed between the docking rail 5 and the projecting end-portions 25 and 26, respectively.

A further aspect of the embodiment illustrated in FIGS. 1 and 2 is that the projecting side end-portions 25, 26 each exhibit an upper and a lower slanted guide face 43, 44 opening up the grip of the fender unit 12, 13 around a docking rail 5 upon vertical sliding contact with a lateral docking rail support strut 9 of the boat landing

2. Such lateral docking rail support struts 9 are visible in FIG. 1. The slanted guide faces 43 engages the lateral docking rail support struts 9 and forces the projecting side end portions 25, 26 apart to disengage the docking rail 5. A suitable slanting angle 0—as illustrated in FIG. 2—is between 45-70 degrees in order to best facilitate an effective opening of the receiving recess 18. In a well performing embodiment, the slanting angle 0 is 56 degrees for both the upper and lower slanting guide faces 43 and 44 respectively.

Figure 4:
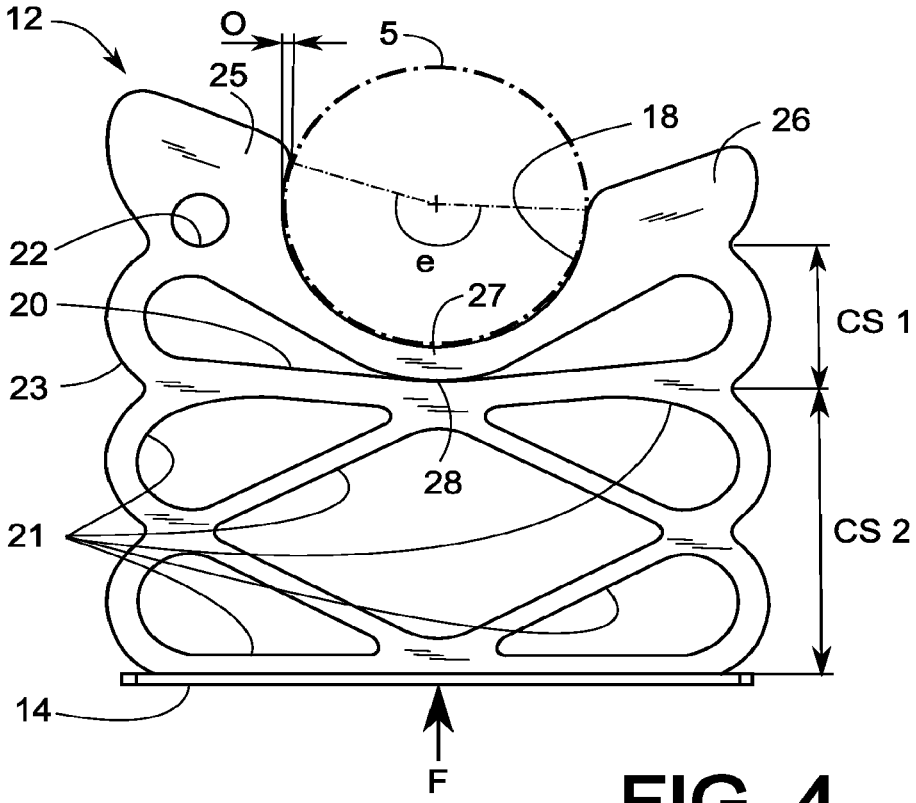
FIG. 4 shows the fender unit according to the first embodiment in a first compression stage where the marine vessel is pressing against the docking rail and the receiving recess embraces the docking rail.

In FIG. 4 the fender unit 12 is shown in a first compression state where the marine vessel 1 (not shown) is pressing against the docking rail 5 with a docking force F indicated by the arrow in the bottom part of the figure. Here, the projecting side end-portions 25, 26 are adapted to elastically press against opposite sides of the docking rail 5 in a compressed state of the fender unit 12 as a central portion 27 of the receiving recess 18 is pressed against the docking rail 5. As shown in the figure, the projecting side end-portions 25, 26 are operationally joined with the central portion 27 of the receiving recess 18. In this compression stage, the receiving recess 18 is shaped to embrace more than half of a cross-sectional outer contour of the docking rail 5 as the fender unit 12 is pressed against the docking rail 5, thus forming a gripping hold of the docking rail 5. As mentioned earlier in the description, the compression of the internal deformation control cavity 20 which is located just inside of the receiving recess 18, in effect controls the elastic deformation of the fender unit 12, 13 and the projecting side end-portions 25, 26 into forming a gripping hold of a docking rail 5 by compression of the internal deformation control cavity 20 when the fender unit 12, 13 is pressed against the docking rail 5. In the shown exemplifying embodiment the internal deformation control cavity 20 exhibits a "boomerang-shaped" horizontal cross section with a narrowing section immediately below a central portion 27 of the receiving recess 18. The fender arrangement now holds on securely to the docking rails 5 using only a fraction of the force used in traditional "push-to-hold" fender arrangements as initially described, which results in substantial cost savings for an operator.

In the shown embodiment, the fender unit 12 is adapted to embrace a docking rail 5 with a circular cross-section with an embracing angle, e, exceeding 180 degrees of the periphery of the docking rail 5. Preferably the embracing angle e is between 185 and 235 degrees of the periphery of the docking rail 5. As shown in FIG. 4, this compression state results in an elastic deformation of the primary deformation control cavity 20 such that the central portion 27 of the receiving recess 18 now touches a central wall portion 28 of the primary deformation control cavity 20. As further shown in FIG. 4, a shape-locking overlap, 0, relative to the outer contour of the docking rail 5 is formed by the first projecting side end-portion 25 which retains the grip of the docking rail 5. A similar overlap may be obtained between the second projecting side end-portion 26 in an alternative, not shown embodiment. It should be noted that the compression state shown in FIG. 4 only causes elastic deformation in the primary deformation control cavity 20, whereas the secondary deformation control cavities 21 remain un-deformed just as they were in the uncompressed state shown in FIG. 3.

Figure 5:
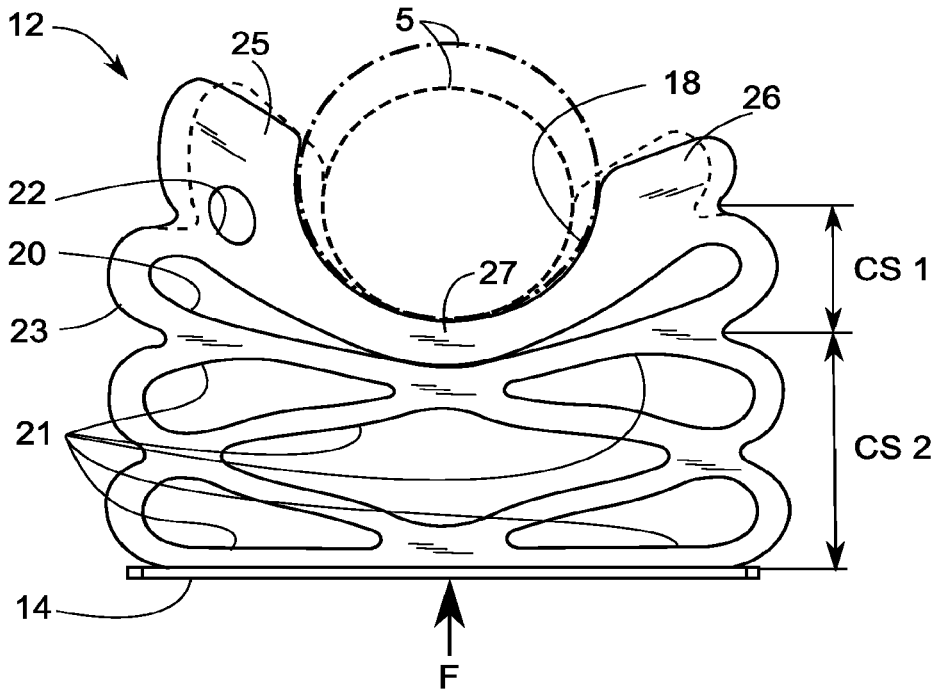
FIG. 5 shows the fender unit according to the first embodiment in a compression stage wherein it has just embraced a docking rail of a smaller diameter than the one shown in FIG. 4.

In FIG. 5 the docking force F is suddenly increased—perhaps as a result of heaving seas—and now the secondary deformation control cavities 21 are beginning to elastically deform under the increased compression of the fenderunit 12. Hence the second compression stage CS 2 has now been initiated, offering a change into stiffer compression resistance than in the initial first compression stage CS 1 which maintains the embrace around the docking rail 5. FIG. 5 further illustrates the ability of the fender unit 12 to accommodate for a docking rail 5 of a smaller diameter as shown with dashed lines—as opposed to the grip around the larger dimension of the docking rail 5 as shown with dash-dotted lines.

Figure 6:
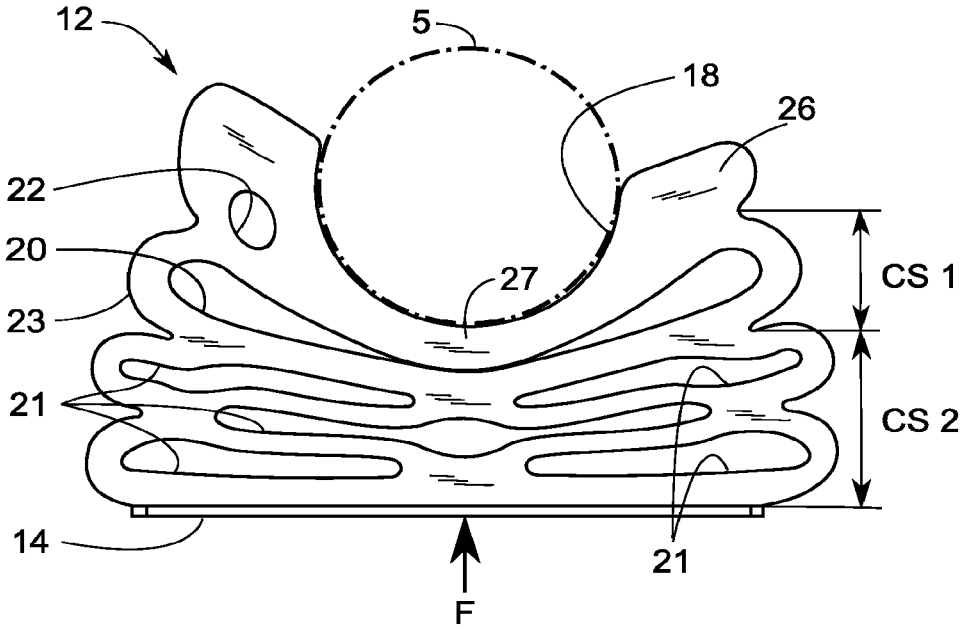
FIG. 6 shows the fender according to the first embodiment in a near maximum compression stage.

In FIG. 6 the docking force F is further increased and now the secondary deformation control cavities 21 are near their maximum compression.

Figure 7:
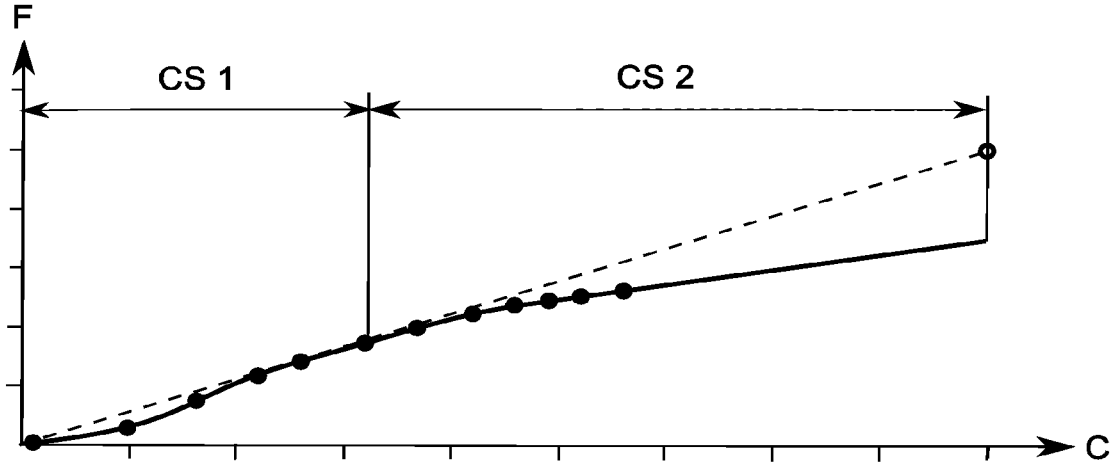
FIG. 7 shows a force versus compression plot of the fender unit according to the first embodiment as shown in FIGS. 1-6.

FIG. 7 shows a plot of docking force F versus compression C from a test performed with a fender unit 12 according to the first embodiment shown in FIGS. 1-6. The straight inclined dashed line indicates a theoretical fender unit with linear compression characteristics as a comparison with the compound compression characteristics of the fender unit 12 according to the present invention. As illustrated, the first weak compression stage CS 1 is clearly distinguished from the relatively stiffer second compression stage CS 2.

Figure 8:
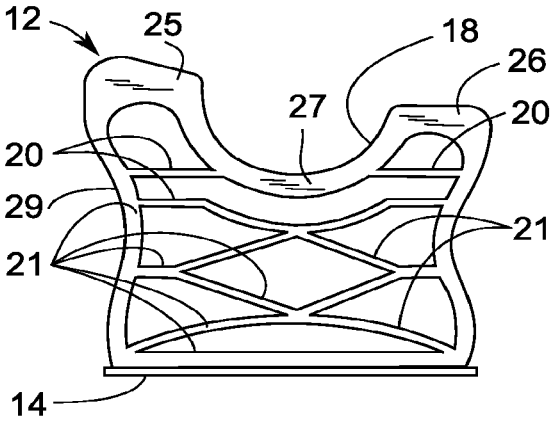
FIG. 8 shows a second, alternative embodiment of a fender unit according to the invention.

A range of alternative embodiments of the port fender unit 12 is illustrated in FIGS. 8-16 that all differ from the first embodiment shown in FIGS. 1-6. Again, the corresponding starboard fender unit 13 is simply a mirror image of the port fender 12, as the starboard fender unit is 13 in fact a port fender unit 12 mounted "upside-down" relative to the port fender unit 12 since the mounting consoles 14 are identical. Hence, FIG. 8 shows a second, alternative embodiment of a port fender unit 12 provided with three primary deformation control cavities 20 and six secondary deformation control cavities 21. This embodiment has concave sides 29, giving the fender unit 12 an hour-glass shape. The number of primary deformation control cavities 20 may in some embodiments exceed the number of secondary deformation control cavities 21 and this relationship—together with the individual shapes of the cavities 20, 21 further contributes to the compound compression characteristics of the fender unit 12 as described above with reference to the plot in FIG. 7, depending on the individual design of the cavities 20, 21.

Figure 9:
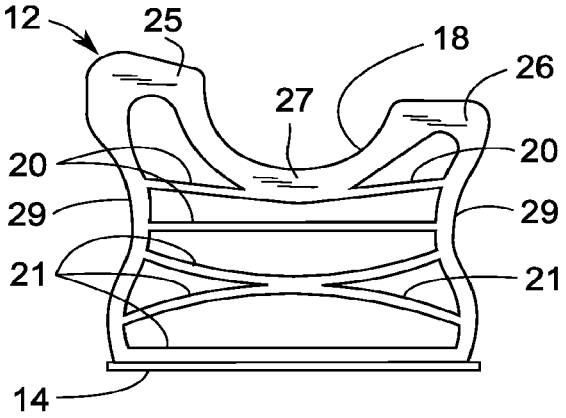
FIG. 9 shows a third alternative embodiment of a fender unit according to the invention.

FIG. 9 shows a third alternative embodiment having the same outer contour as the second embodiment. This one is also provided with three primary deformation control cavities 20, but has only and four secondary deformation control cavities 21.

Figure 10:
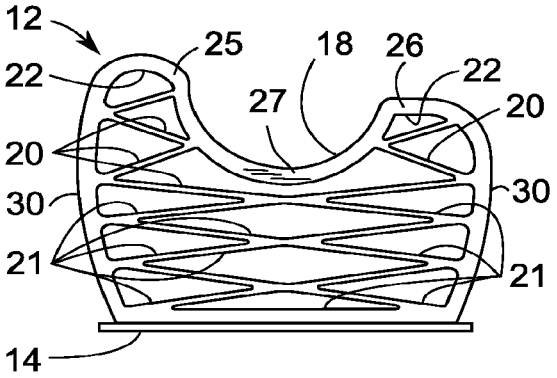
FIG. 10 shows a fourth alternative embodiment of a fender unit according to the invention.
Figure 11:
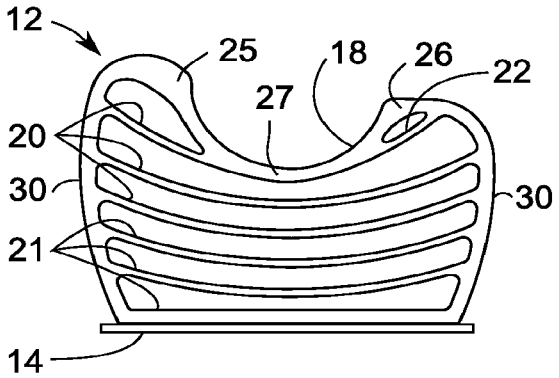
FIG. 11 shows a fifth alternative embodiment of a fender unit according to the invention.

FIG. 10 illustrates a fourth alternative embodiment with convex sides 30, giving the fender a rounded, bulging shape. It is provided with four primary deformation control cavities 20, nine secondary deformation control cavities 21 and two weight-saving cavities 22. The primary deformation control cavities 20 and the secondary deformation control cavities 21 both diamond-shaped and triangular. FIG. 11 shows a fifth alternative embodiment having the same outer contour as the fourth embodiment. This one is provided with three primary deformation control cavities and three secondary deformation control cavities 21. The three secondary deformation control cavities 21 extend from side to side of the fender unit 12. More embodiments of the fender units 12 are feasible within the inventive concept limited only by the accompanying claims, but are not shown per se.

Figure 12:
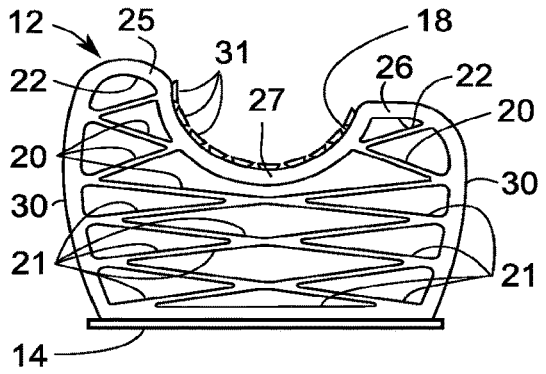
FIG. 12 shows a sixth alternative embodiment of the invention wherein the receiving recess of the fender unit is provided with multiple suction cup elements adapted to adhere by suction to the docking rail as the fender unit is pressed against the docking rail.

FIG. 12 shows a sixth alternative embodiment of the invention wherein the receiving recess 18 of the fender unit is provided with multiple suction cup elements 31 adapted to adhere by suction to the docking rail 5 (not shown in this figure) as the fender unit 12 is pressed against the docking rail 5. The suction cup elements 31 provides an additional gripping effect on the docking rail 5 even though the fender unit 12 still operates with the embracing action described with respect to the previously described embodiments. The suction cup elements 31 are evenly distributed in the receiving recess 18.

Figure 13:
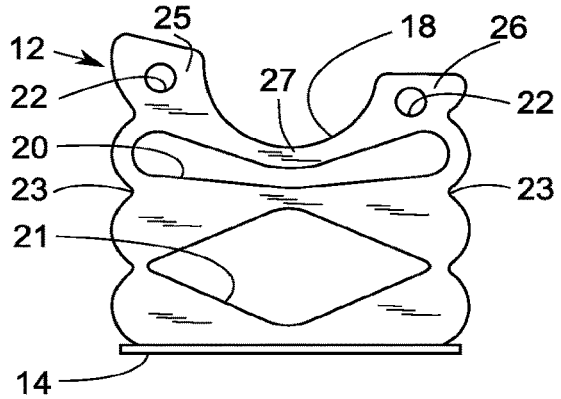
FIG. 13 shows a seventh alternative embodiment of the invention provided with a single primary internal deformation control cavity and a single secondary internal deformation control cavity.

A seventh embodiment is shown in FIG. 13, provided with a single primary internal deformation control cavity 20, a single secondary internal deformation control cavity 21 and two weight-saving cavities 22. This embodiment shares the same outer contour as the initially described first embodiment, with its undulating accordion shaped sides 23.

Figure 14:
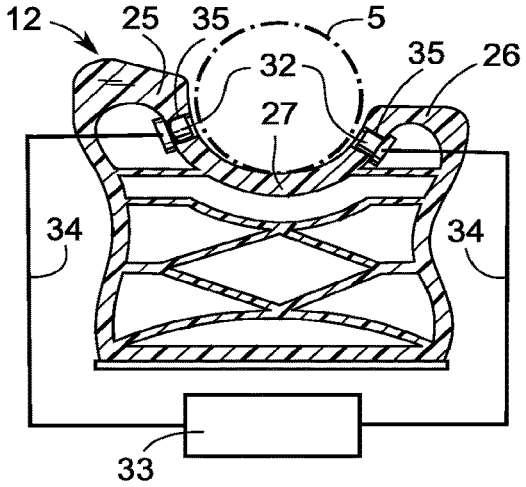
FIG. 14 shows an eight alternative embodiment of a fender unit according to the invention, provided with electromagnets in the walls of the receiving recess.

An eight embodiment is shown in FIG. 14, wherein the projecting side end-portions 25, 26 of the fender unit 12 is provided with electromagnets 32 which are externally activated by a control unit 33 via control-and power lines 34 to magnetically grip a docking rail 5 made of a ferrous material. The electromagnets 32 are arranged within apertures 35 in the projecting side end-portions 25, 26 in such a way that a small gap is formed between the electromagnets 32 and the docking rail 5 during a docking procedure in order to avoid direct contact and resulting wear or surface damage to the docking rail 5. In an alternative—not shown—embodiment, a single electromagnet may be provided in either of the projecting side end-portions 25, 26 of the fender unit 12. The electromagnets further increases the hold on the docking rails 5, further reducing the docking force F required to maintain the marine vessel 1 in a docking position.

Figure 15:
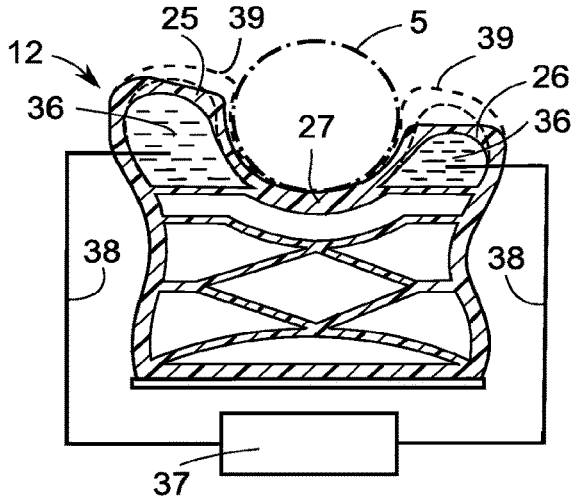
FIG. 15 shows a ninth alternative embodiment of a fender unit according to the invention, the side end-portions are provided with pneumatically or hydraulically activated hollow expansion bodies.

A ninth embodiment is shown in FIG. 15, wherein the projecting side end-portions 25, 26 are provided with pneumatically or hydraulically activated hollow expansion bodies 36 for enabling externally activated expansion of said side end-portions 25, 26. This causes an active gripping action against the docking rail 5 by inflating the hollow expansion bodies 36. The activation is selectively controlled via a control apparatus 37 with means for supplying pneumatic or hydraulic pressure to the expansion bodies 36 via fluid conduits 38. In an expanded state, the projecting side end-portions 25, 26 are designed to expand to form a shape locking grip of the outer contour of the docking rail as illustrated by the dashed lines 39 in the figure. This shape-locking grip further increases the hold on the docking rails 5, further reducing the docking force F required to maintain the marine vessel 1 in a docking position with no or a minimum docking force F.

Figure 16:
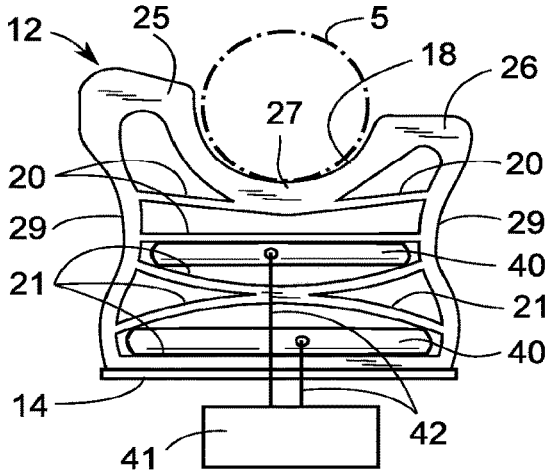
FIG. 16 shows a tenth alternative embodiment of a fender unit according to the invention, with pneumatically or hydraulically activated hollow stiffening bodies for enabling external active variable deformation stiffness control via a control apparatus. In this figure, the stiffening bodies are not pressurized and expanded.
Figure 17:
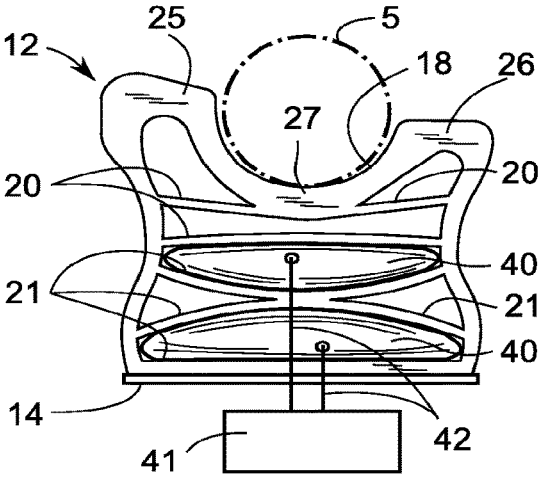
FIG. 17 shows finally shows the tenth alternative embodiment as seen in FIG. 16, but here the stiffening bodies are shown in a pressurized and expanded state.

Finally, a tenth embodiment is shown in FIGS. 16 and 17, wherein two of the secondary internal deformation cavities 21 are provided with a pneumatically or hydraulically activated hollow stiffening bodies 40 for enabling external active variable deformation stiffness control of the fender unit 12, 13 via a control apparatus 41 with means for supplying pneumatic or hydraulic pressure to the stiffening bodies 40 via fluid conduits 42. In an alternative—not shown—embodiment, a single stiffening body 40 may be provided in either of the secondary internal deformation cavities 21 of the fender unit 12. In FIG. 16, the stiffening bodies 40 are not pressurized and expanded. In FIG. 17 the stiffening bodies 40 are shown in a pressurized and expanded state in which they essentially fill up their respective secondary deformation control cavities 21.

It is to be understood that the present invention is not limited to the embodiments described above and illustrated in the drawings and a skilled person will recognize that many changes and modifications may be made within the scope of the appended claims.

What is claimed is:

1. A fender unit comprising:

a fender body comprising an elastically deformable material;

a receiving recess sized and shaped to correspond with a docking rail of a boat landing, a surface of the receiving recess includes a friction enhancing pattern;

an internal deformation control cavity positioned within the fender body at a distance from the receiving recess;

an internal deformation control cavity or group of cavities within the fender body that are positioned at a distance from the receiving recess;

a primary internal deformation control cavity or group of cavities located adjacent to the receiving recess, providing a first, compression stage as the fender unit is pressed against a docking rail, and a secondary internal deformation control cavity or group of cavities located farther from the receiving recess relative to the first deformation control cavity or group of cavities providing a second, stiffer compression stage relative to the first compression stage.

2. The fender unit according to claim 1, wherein the friction-enhancing pattern is a diagonal square or diamond shape.

3. The fender unit according to claim 1, wherein the friction-enhancing pattern is molded in relief in the fender body.

4. The fender unit according to claim 1, wherein the fender body forms a gripping hold when pressed against a docking rail.

5. The fender unit according to claim 4, wherein the gripping hold is formed by compression of the internal deformation control cavity or group of cavities when the at least one fender body is pressed against the docking rail.

6. The fender unit according to claim 1, wherein the friction-enhancing pattern is configured to increase a grip between the fender body and a docking rail.

7. The fender unit according to claim 1, wherein at least one secondary internal deformation cavity is provided with a pneumatically or hydraulically activated hollow stiffening body for enabling external active variable deformation stiffness control via a control apparatus.

8. The fender unit according to claim 1, wherein the receiving recess is wider than the docking rail in an uncompressed state of the fender body and the fender body comprises a first projecting side end-portion and a second projecting side end-portion forming sides of the receiving recess;

wherein the first projecting side end-portion and/or the second projecting side end-portion elastically press against opposite sides of a docking rail when the fender body is pressed against the docking rail in a compressed state of the fender body as a central portion of the receiving recess is pressed against the docking rail and the internal deformation control cavity is compressed; and wherein the first projecting side end-portion and/or the second projecting side end-portion are operationally joined with the central portion of the receiving recess.

9. The fender unit according to claim 8, wherein the first projecting end-portion protrudes further than the second projecting end-portion.

10. The fender unit according to claim 8, wherein each of the first projecting side end-portion and the second projecting side end-portion include an upper and a lower slanted guide face that opens up a grip of the fender body around a docking rail upon vertical sliding contact with a lateral docking rail support strut of the boat landing, the slanted guide faces engaging the lateral docking rail support strut and forcing the first projecting side end-portion and the second side end-portion apart to disengage the docking rail.

* * * * *